United States Patent [19]

Vincenzini

[11] Patent Number: 4,939,886

[45] Date of Patent: Jul. 10, 1990

[54] APPARATUS FOR FILLING TRAYS WITH CIGARETTES

[75] Inventor: Franco Vincenzini, Calata Pepoli-Crevalcore, Italy

[73] Assignee: Sasib S.p.A., Italy

[21] Appl. No.: 299,649

[22] Filed: Jan. 23, 1989

[30] Foreign Application Priority Data

Mar. 9, 1988 [IT] Italy ..... 12435A/88

[51] Int. Cl.[5] ..... B65B 19/10; B65B 39/02

[52] U.S. Cl. ..... 53/236

[58] Field of Search ..... 53/148, 149, 236, 245, 53/248, 260, 535, 537, 151; 221/93, 297

[56] References Cited

U.S. PATENT DOCUMENTS

| | | | |
|---|---|---|---|
| 1,765,820 | 6/1930 | Bronander et al. | 53/149 |
| 2,535,880 | 12/1950 | Tomkins | 53/149 |
| 2,826,883 | 3/1958 | Pollmann | 53/236 |
| 3,320,717 | 5/1967 | Molins et al. | 53/236 X |
| 3,479,794 | 11/1969 | Osterdahl | 53/236 X |
| 3,531,911 | 10/1970 | Gianese | 53/236 X |
| 3,608,270 | 9/1971 | Rudszinat et al. | 53/236 X |
| 3,924,386 | 12/1975 | Schmermund | 53/236 X |
| 4,507,903 | 4/1985 | Focke et al. | 53/236 X |
| 4,827,691 | 5/1989 | Hanada et al. | 53/151 |

*Primary Examiner*—Robert L. Spruill

*Assistant Examiner*—Beth Bianca

*Attorney, Agent, or Firm*—Larson and Taylor

[57] ABSTRACT

An apparatus for filling trays with cigarettes, or the like, comprises a cigarette-supplying hopper (1) at the outlet of which there is arranged a plurality of vertical or slightly inclined, generally parallel channels (2), or a plurality of passages defined by equispaced adjacent rollers, through which the cigarettes move down by gravity, the width of channels (2) and the distance between the rollers being slightly greater than the cigarette diameter, provision being made of means for facilitating the cigarette downward movement and of means for interrupting it. In order to facilitate the descent of the cigarettes, the channels (2) are so made as to be swingable to and fro, transversely to the direction of the cigarette downward movement. In order to interrupt the descent of the cigarettes, the two facing sidewalls (13) of each channel (2) are so made as to be at least in part elastically pliable and susceptible of converging under the action of contrary transversal forces, in such a manner than in proximity of its outlet each channel (2) for the cigarette transit comes to have a width which is smaller than the cigarette diameter, while when in rest condition, i.e., when the said forces are absent, the width of each channel is greater than the cigarette diameter.

15 Claims, 6 Drawing Sheets

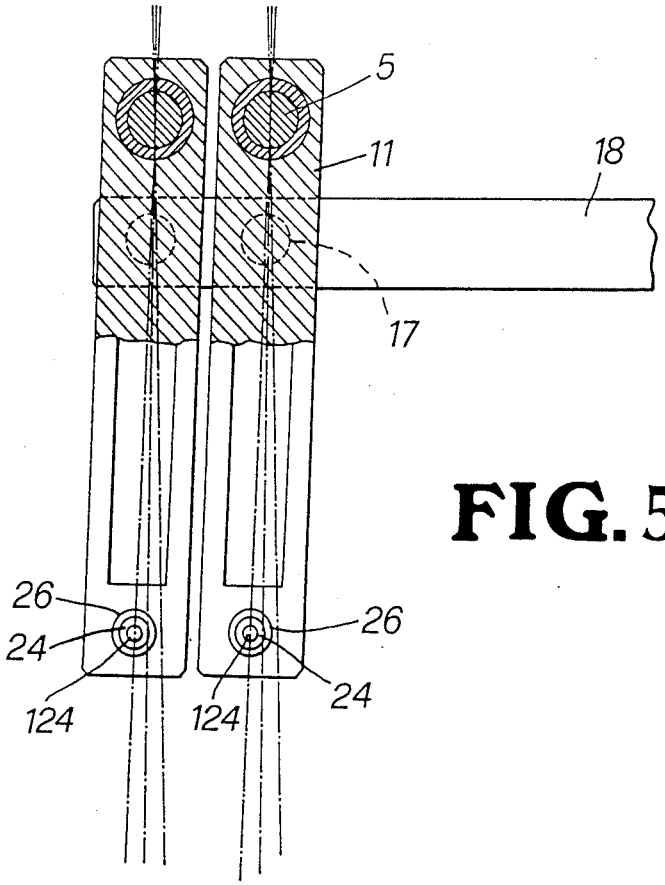
FIG. 5
FIG. 6
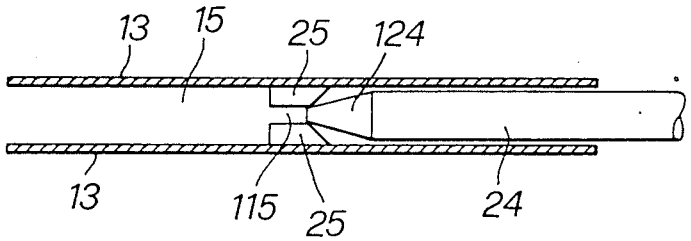

APPARATUS FOR FILLING TRAYS WITH CIGARETTES

SUMMARY OF THE INVENTION

The present invention relates to an apparatus used for directly filling trays, boxes, and containers in general, with cigarettes, filter plugs, and any similar rod-like articles, particularly in the tobacco industry, which apparatus comprises a cigarette-supplying hopper at the outlet of which there is arranged a plurality of vertical or slightly inclined, generally parallel channels, or a plurality of passages defined by equispaced adjacent rollers, through which the cigarettes move down by gravity, the width of the channels and the distance between the rollers being slightly greater than the cigarette diameter, provision being made of means for facilitating the cigarette downward movement, and of means for interrupting it, for example when a tray is full and must be replaced with an empty tray.

Presently the means for facilitating the descent of the cigarettes generally consist of rotatable driven rollers which are cylindrically shaped and are provided with a knurling, or a polygonal in cross-section, or else these means consist of pendulum-like means or oscillating rollers. The means for interrupting the descent of the cigarettes may be of the pneumatic type, and may, for example, be in form of suction ports arranged in correspondence of the channel outlets, otherwise they may consist of a row of small rollers which upon control are moved from their usual position in which they are vertically aligned with the rollers defining the cigarette passages, into a position in line with the axes of said passages, that thus become blocked.

In the present state of the art, the units controlling the means that mechanically intercept the cigarettes are of a relatively complicated construction, and the means that pneumatically intercept the cigarettes, while affording the advantage of no movement being needed of any cigarette-contacting part, are not entirely reliable since the suction ports may be obstructed by some tobacco which inevitably drops from the cigarette ends.

The invention aims to provide a filling apparatus of the type as described in the preamble, in which the means for facilitating the descent of the cigarettes, and the means for interrupting their descent are so designed that they are remarkably simple in construction and of a low manufacturing cost, and are also fully reliable in respect of the cigarette soundness.

The invention attains the said object by the feature that in a filling apparatus as disclosed in the preamble, the channels are so made as to be swingable to and fro, transversely to the direction of the cigarette downward movement, to facilitate the descent of the cigarettes.

In order to interrupt the descent of the cigarettes, the two facing sidewalls of each channel are so made as to be at least in part elastically pliable and susceptible of converging under the action of contrary forces, in such a manner that in proximity of its outlet each channel for the cigarette transit comes to have a width which is smaller than the cigarette diameter, while when in rest condition, i.e., when the said forces are absent, the width of each channel is at least slightly greater than the cigarette diameter.

The apparatus according to the invention firstly affords the advantage that the channels are assigned both the task of quincuncially distributing the cigarettes within a tray (thanks to the oscillation of said channels), and the task of interrupting the descent of the cigarettes (thanks to the possibility of blocking the channels), so that the use of any other devices meant for performing the said functions becomes unnecessary, with the result of obtaining a lower expense and an economy in construction.

Forming the object of the invention are also other features which further improve the filling apparatus as disclosed above, and which are the subject of the dependant claims.

BRIEF DESCRIPTION OF THE DRAWINGS

The particular features of the invention and the advantages arising therefrom will appear in more detail from the specification of some preferred embodiments, shown by way of non-limiting examples in the accompanying drawings, in which:

FIG. 5 is a sectional view on line V—V in FIG. 1.

FIG. 6 is a view in an enlarged scale, showing a detail of the device for forcing apart the walls of a cigarette-distributing channel.

DESCRIPTION OF THE PREFERRED EMBODIMENTS

Figure 1:
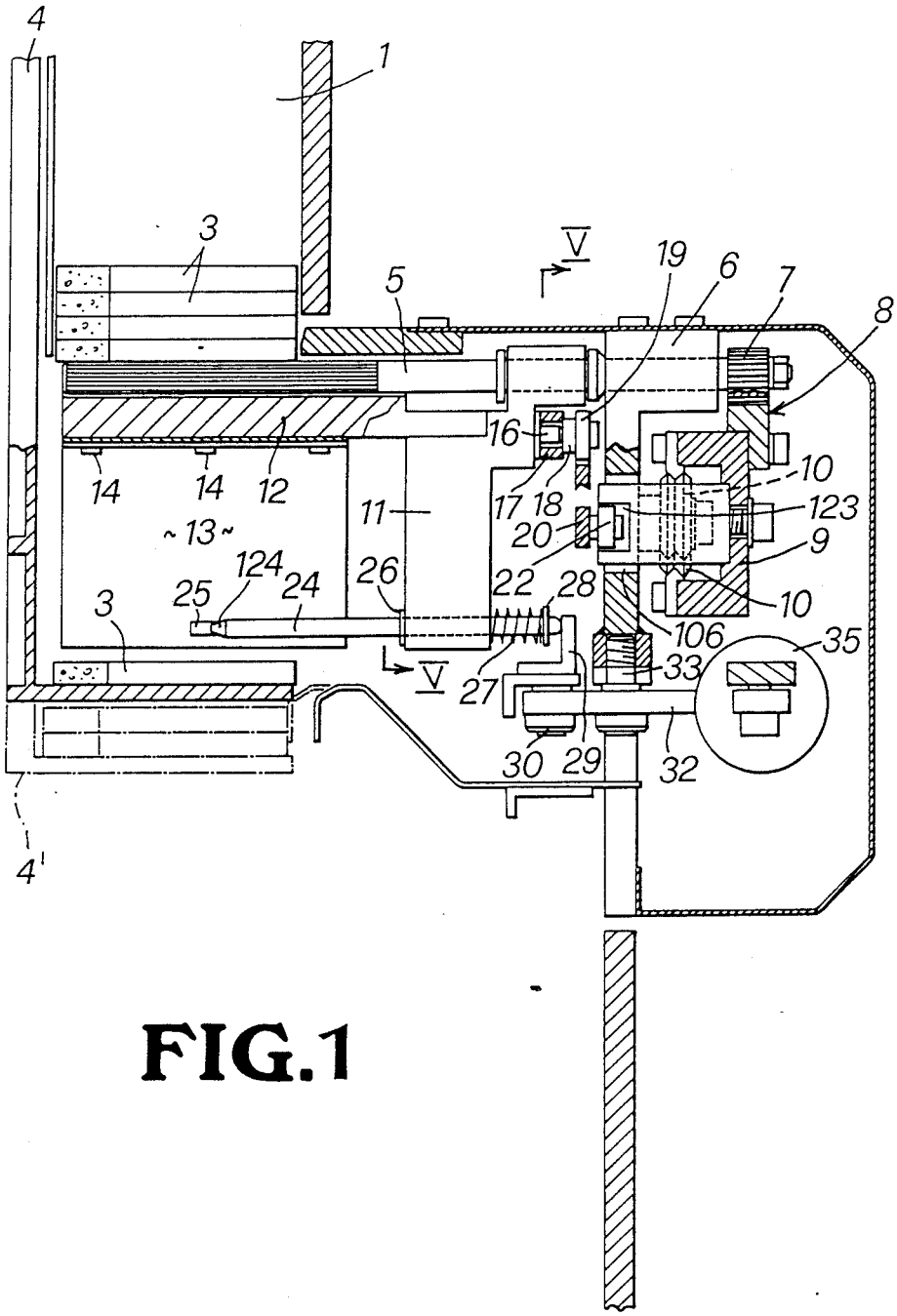
FIG. 1 is a vertical cross-sectional view showing a tray-filling apparatus according to the invention.

The apparatus shown in FIG. 1 is for filling trays 4 with cigarettes 3. This apparatus comprises a cigarette-supplying hopper 1, and at the outlet of said hopper a plurality of channels 2 for the cigarettes 3 are located, and are designed for distributing the cigarettes in a quincuncial arrangement within the tray 4. The tray 4 is vertically lowered while the filling level is increasing. Numeral 4' denotes an intermediate position shown by dash-and-dot lines, of the tray.

Arranged in a spaced apart parallel relation directly over the inlet of each cigarette-distributing channel 2 are two horizontal cylindrical rollers 5, which are supported for rotation around their co-planar longitudinal axes by the wall 6 of the filling apparatus frame. The section of rollers 5 in the region of channels 2 has a longitudinal knurling, while at the end lying opposite to the region of channels 2, each roller has a pinion 7 in mesh with a rack 8 secured to a slide 9 which is mounted on supporting rollers 10 provided with a V-shaped groove and overhangingly supported by the wall 6.

In the median zone of each roller 5, between the knurled section thereof and the wall 6 of the frame, each roller 5 rotatably supports a rocker arm 11 to which a ledge 12 is secured in a cantilevered manner and extends horizontally underneath the roller, throughout the length of the knurled section thereof. The upper side of said ledge 12, which is turned toward the roller 5, is concavely shaped (see FIGS. 2 to 4). Each pair of spaced apart, adjacent ledges 12 form the inlet of the respective cigarette-distributing channel 2 (FIG. 2 to 4).

A pair of downwardly extending, spaced apart, flexible vertical plates 13 is secured by means of screws 14 to the lower side of each ledge 12, and the outward surface thereof is substantially flush with the outer sidewall of the respective ledge 12. This pair of plates 13 form under each ledge 12 a clear hollow space 15 (FIGS. 2 to 4). The two pairs of facingly arranged plates 13 which are associated with two adjacent ledges, form the sidewalls of a cigarette-distributing channel 2.

Each rocker arm 11 is provided on its side which is opposite to channels 2 and is under the rollers 5, with a pivot 16 which is engaged in a bushing 17 carried by a horizontal driving bar 18 provided with a row of equispaced bushings 17.

Figure 2:
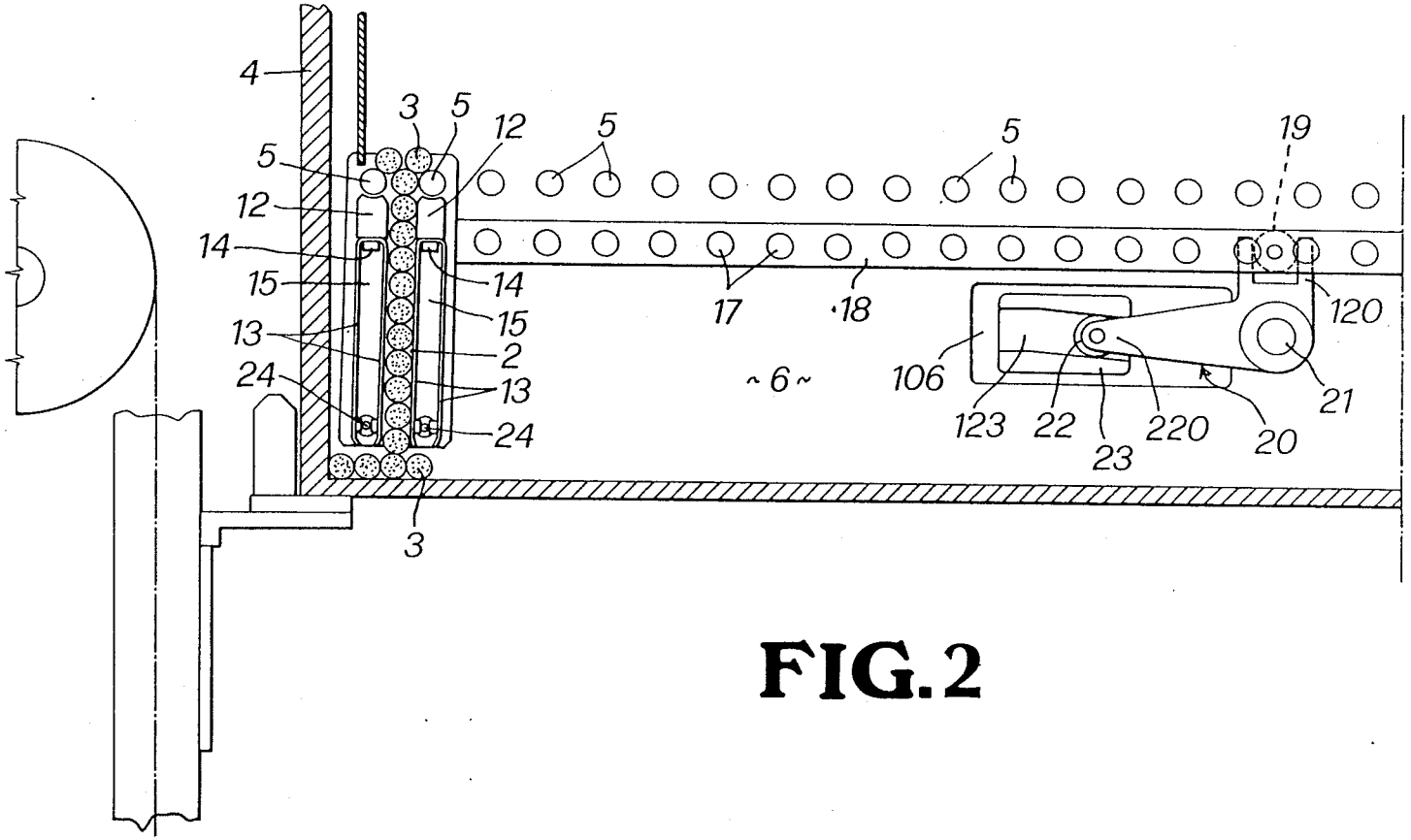
FIG. 2 shows the filling apparatus according to the invention in a vertical sectional view in the longitudinal direction of a tray, only one cigarette-distributing channel being illustrated in its rightwards inclined position.
Figure 3:
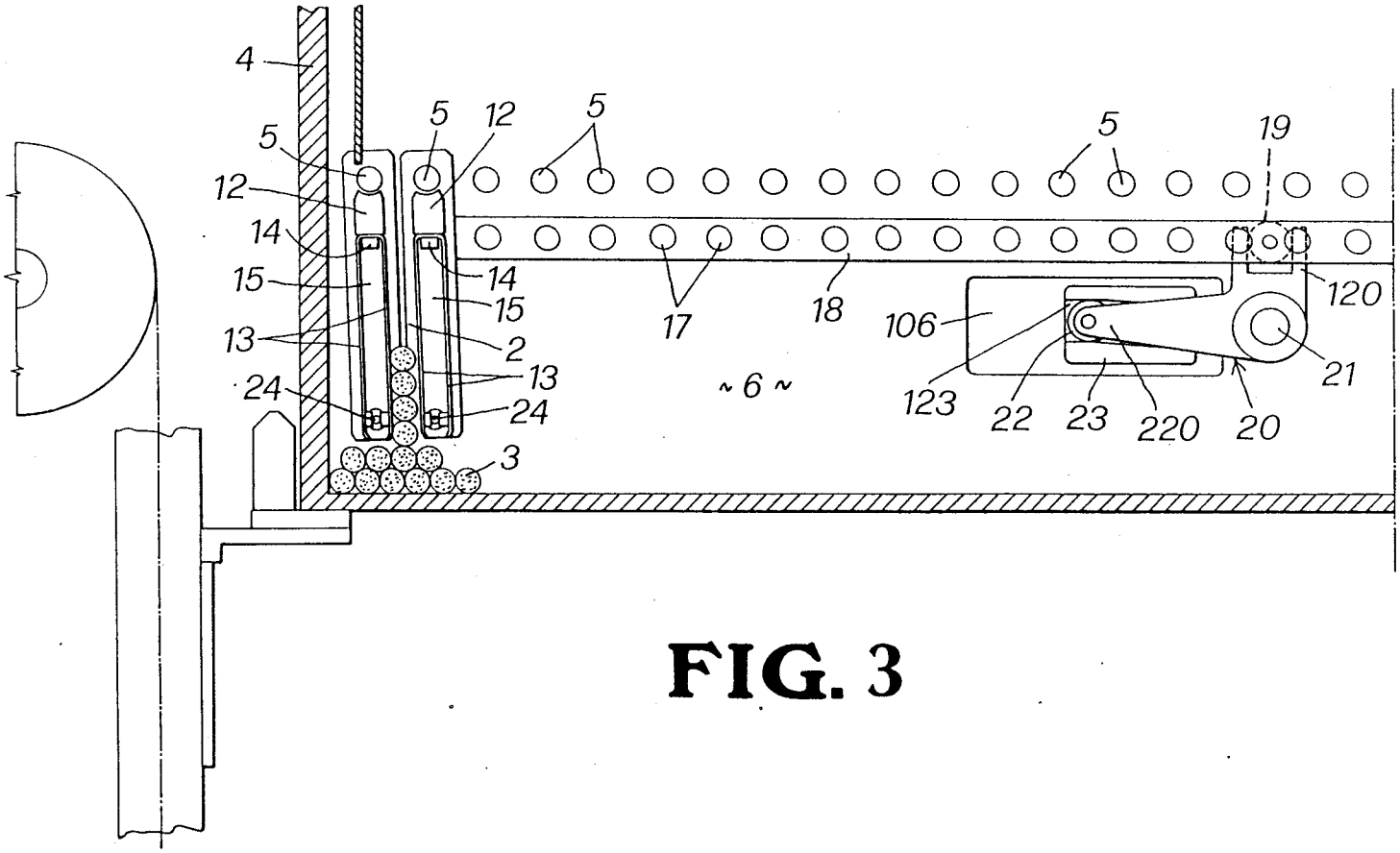
FIG. 3 is a view similar to that of FIG. 2, however with the cigarette-distributing channel being inclined to the left.
Figure 4:
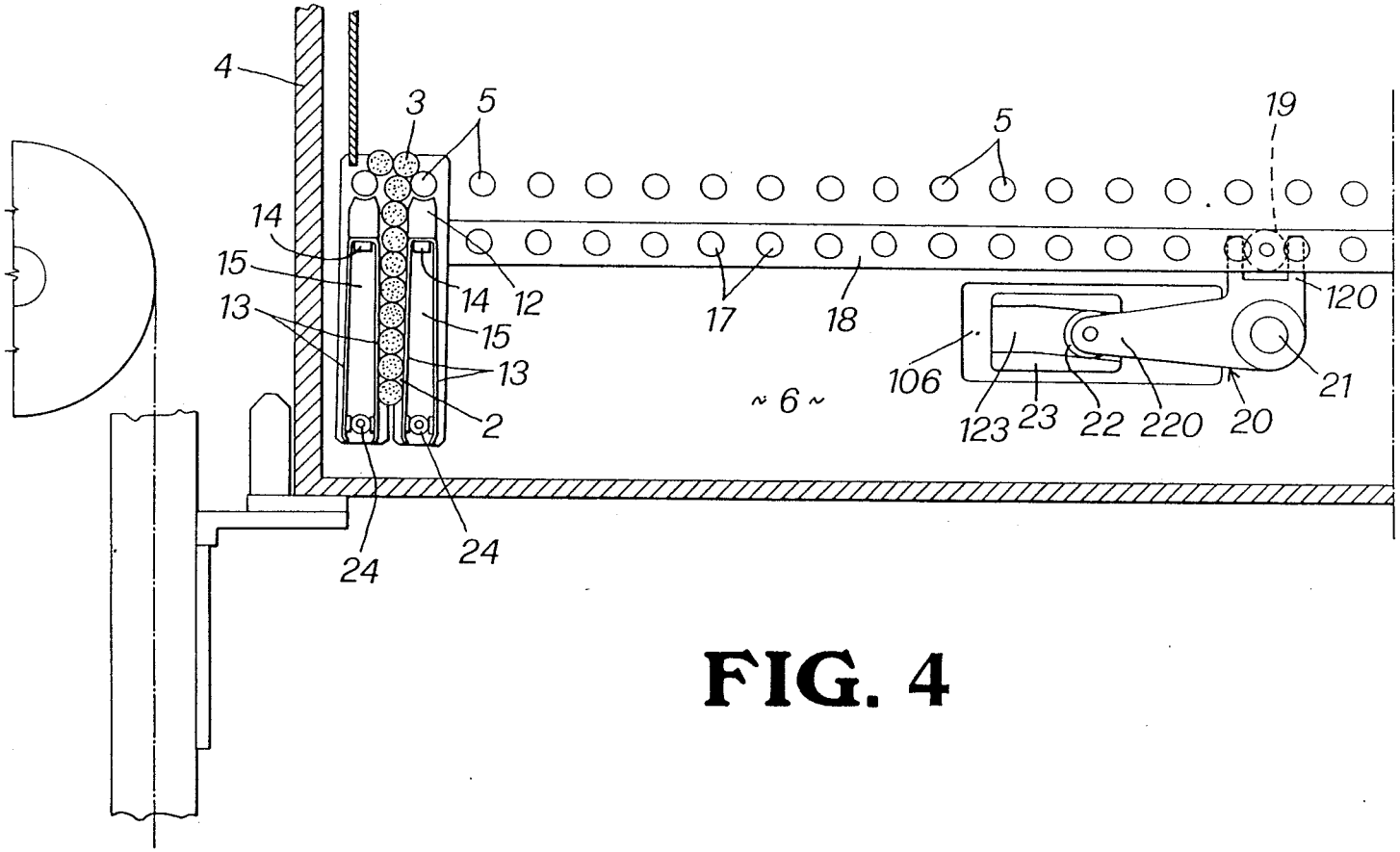
FIG. 4 is a view similar to that of FIGS. 2 and 3, however with the cigarette-distributing channel in its cigarette descent-interrupting position.

As it clearly appears in FIGS. 1 to 4, the driving bar 18 supports in an intermediate zone thereof a roller 19 engaged in the fork-shaped end 120 of an L-shaped lever 20 which is pivotally connected at 21 to the wall 6 of the frame, so as to be swingable in a vertical plane. At its opposite end 220, the lever 20 carries a roller 22 which is passed through a slot 106 in the wall 6 of the frame, and is engaged in the groove 123 of a planar cam 23 secured to the slide 9. The reciprocating motion of slide 9 and then of cam 23, is transmitted through the lever 20 to the bar 18, so that the bar 18 is reciprocated in the longitudinal direction thereof, and imparts the rocker arms 11 fulcrumed about the rollers 5, an oscillating movement through the pivots 16 and the bushings 17 (see FIGS. 2 to 5). Such an oscillating movement is transmitted also to the plates 13, so that the cigarette-distributing channels 2 are caused to swing to and fro transversely to the cigarettes 3. The amplitude of the said oscillating movement of the cigarette-distributing channels 2 preferably is such that the cigarettes 3 being deposited into the tray 4 are set in a quincuncial arrangement, as shown in FIGS. 2 and 3.

Moreover, at its lower end each rocker arm 11 supports a longitudinally slidable pin 24 protruding horizontally into the middle of the clear hollow space 15 enclosed between the pair of plates 13 associated with each ledge 12, slightly over the bottom end of said plates 13. The end 124 of each pin 24, located at the interior of the hollow spaces 15 is tapered, particularly in form of a cone, and when the pin 24 is so positioned as to protrude in the least degree, the said end is disengaged from a flared inlet narrowing 115 formed in the hollow space 15 by means of two small hard metal blocks 25 secured each to one of the two facing plates 13 (see FIG. 6).

At the end of pin 24 which is opposite to its point 124, a spring 27 is interposed between a flange 28 on pin 24 and the side of the rocker arm 11 which is opposite to the cigarette-distributing channels 12, and this spring urges the pin 24 into position in which the conical point 124 is disengaged from the narrowing 115, this position being determined thanks to a stop ring 26 on pin 24, which cooperates with the side of the rocker arm 11 which is turned toward the channels 2.

Figure 7:
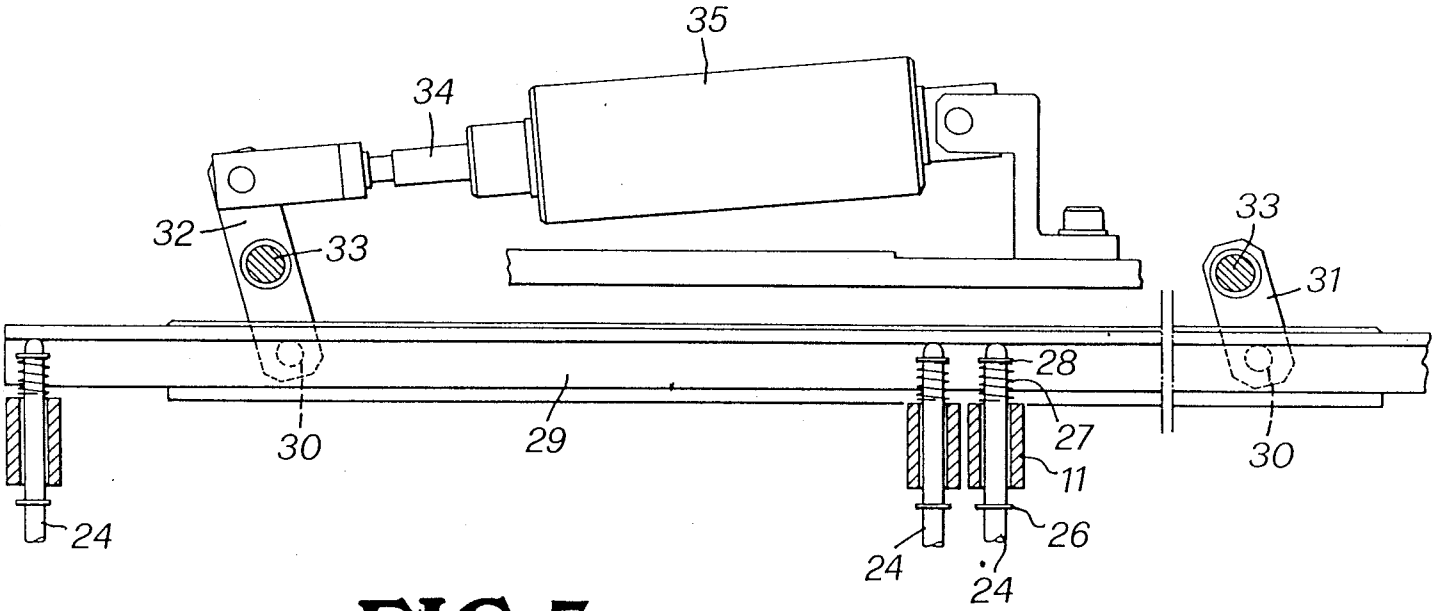
FIG. 7 shows the device for operating the device for forcing apart the walls of the cigarette-distributing channels.

The end of each pin 24 which is opposite to the conical point 124 thereof, cooperates with a pushing cross bar 29 articulatingly connected at 30 to two small parallel levers 31, 32, so mounted as to be swingable in a horizontal plane about pivots 33 on the wall 6 of the frame, whereby an articulated parallelogram is formed. The lever 32 has a section extending beyond the pivot 33, and this extension is articulatingly connected to the stem 34 of a pneumatic cylinder 35 (see FIG. 7).

The forward and backward stroke of the stem 34 of the pneumatic cylinder 35 causes the levers 31, 32 to be swung to and fro, and so causes the pushing cross bar 29 to be moved in a horizontal plane, parallel to itself. Thanks to the pushing action of the pushing cross bar 29, the pins 24 are moved toward the interior of the hollow space 15 and the pivot 124 is then drawn in between the small blocks 25, thus forcing them apart and giving rise to an outward bending of plates 13. As it clearly appears in FIG. 4, such a bending of plates 13 produces a narrowing of the cigarette-distributing channels 2, to such an extent that the width of each channel 2 becomes smaller than the cigarette diameter. With such an expedient, it is therefore possible to stop the descent of the cigarettes, for example, to replace a full tray with an empty tray, by simply operating the pneumatic cylinder 35. The cigarette descent is interrupted in an extremely delicate manner and without the aid of any mechanical means acting on the cigarette mass, so that there is no more any risk of the cigarettes becoming crushed by being unsuitably pressed against internal members.

I claim:

1. An apparatus for filling a tray with rows of rod-like articles such as cigarettes in a quincuncial arrangement comprising:

an article supplying hopper having an outlet through which the articles contained therein move by gravity;

a frame;

a plurality equispaced lateral sidewalls arranged parallel to one antother and below the outlet of said hopper so as to define between respective adjacent said sidewalls respective article receiving channels through which the articles are singly stacked and moved by gravity, each said sidewall including two facing lateral plates;

a respective article roller disposed between an upper end of each respective said sidewall and said hopper, adjacent said article rollers defining therebetween an inlet for an associated said channel;

a roller moving means for imparting rotary motion to all of said article rollers;

a sidewall mounting means for mounting respective lower ends of all of said sidewalls for simultaneous and identical reciprocal motion relative to said frame and the tray;

a sidewall moving means for laterally moving all of said lower ends of said sidewalls in a reciprocating motion relative to said frame whereby the articles are deposited in the tray in a quincuncial arrangement; and a spreading means for spreading apart associated said lateral plates of all of said sidewalls at any position of the reciprocating said sidewalls such that a distance between adjacent said sidewalls is immediately reduced from that which is larger than a diameter of the articles allowing passage of the articles along said channels to that which is smaller than the diameter of the articles to prevent passage of the articles along said channels regardless of the position of said reciprocating sidewalls.

2. An apparatus for filling a tray as claimed in claim 1 wherein each said article roller includes an axial extension; and wherein said sidewall mounting means includes a support to which each said sidewall is mounted, each said support being mounted for free rotation about a respective said extension of a respective said article roller adjacent thereto.

3. An apparatus for filling a tray as claimed in claim 2 wherein at least one of said roller moving means and said sidewall moving means includes a slide mounted for movement relative to said frame and a slide moving means for reciprocally moving said slide.

4. An apparatus for filling a tray as claimed in claim 3 wherein said sidewall moving means includes a driving bar to which each said support is attached and a drive means for driving said driving bar in a reciprocating motion.

5. An apparatus for filling a tray as claimed in claim 4 wherein said drive means includes (a) a drive roller attached to an intermediate portion of said driving bar, (b) an L-shaped lever having a forked shaped end in which said drive roller is received, a corner which is pivotally mounted to said frame, and an opposited end, (c) a cam roller attached to said opposite end of said lever, and (d) a cam mounted on said slide having a groove in which said cam roller is received.

6. An apparatus for filling a tray as claimed in claim 5 wherein said driving bar includes a row of equispaced bushings; and wherein said sidewall mounting means includes a pivot extending from each said support which is received in a respective said bushing.

7. An apparatus for filling a tray as claimed in claim 3 wherein said roller moving means includes a rack provided on said slide and respective pinions provided on each said extension of said article rollers which engage said rack.

8. An apparatus for filling a tray as claimed in claim 7 wherein each said article roller includes longitudinal knurls adjacent the respective said channel.

9. An apparatus for filling a tray as claimed in claim 7 wherein said sidewall moving means includes a driving bar to which each said support is attached and a drive means operatively connected to slide for driving said driving bar in a reciprocating motion.

10. An apparatus for filling a tray as claimed in claim 1 wherein said spreading means includes a respective pair of blocks disposed in a space between each of said facing plates of said sidewalls and defining an opening between said facing plates, a respective pin having a tapered distal end which is received in each respective said opening to force said blocks and hence associated said facing plates apart, and a pushing means for pushing all of said tapered ends of said pins into respective said openings and between said blocks.

11. An apparatus for filling a tray as claimed in claim 10 wherein said plates of said sidewalls are flexible.

12. An apparatus for filling a tray as claimed in claim 10 wherein each said article roller includes an extension; and wherein said sidewall mounting means includes a support to which each said sidewall is mounted, each said support being mounted for free rotation about a respective said extension of a respective said article roller adjacent thereto.

13. An apparatus for filling a tray as claimed in claim 12 wherein each said support includes a pin mounting means for mounting a respective said pin for reciprocating motion therein.

14. An apparatus for filling a tray as claimed in claim 13 wherein said pin mounting means includes a respective stop mounted on a respective said pin between a respective said support and a respective said channel which limits the movement of the associated said pin by engagement with said support, and a respective return spring means mounted on a respective said pin between said support and a respective said distal end of said pin for urging said pin away from respective said blocks until said respective stop engages said respective support.

15. An apparatus for filling a tray as claimed in claim 13 wherein said pin pushing means includes (a) a cross bar, (b) two parallel levers which are articulatingly connected to said frame whereby an articulated parallelogram is formed by said cross bar, said frame and said parallel levers, and (c) an actuator means for moving said cross bar relative to said frame.

* * * * *